United States Patent [19]

Radzins

[11] 4,141,509

[45] Feb. 27, 1979

[54] BALE LOADER FOR FLUFF GENERATOR

[75] Inventor: Edmund A. Radzins, Sheboygan Falls, Wis.

[73] Assignee: Curt G. Joa, Inc., Sheboygan Falls, Wis.

[21] Appl. No.: 867,734

[22] Filed: Jan. 6, 1978

[51] Int. Cl.[2] ..... B02C 9/00; B02C 13/286

[52] U.S. Cl. ..... 241/30; 241/101 A; 241/186.2; 241/186.4

[58] Field of Search ..... 241/28, 30, 101 A, 101.5, 241/101.2, 186 R, 186.2, 186.4; 214/301, 302

[56] References Cited

U.S. PATENT DOCUMENTS

| | | | |
|---|---|---|---|
| 2,650,745 | 9/1949 | Oberwortman | 241/186 |
| 3,561,072 | 2/1971 | Oster et al. | 241/186 |
| 3,615,059 | 10/1971 | Moeller | 241/186.4 X |
| 3,967,785 | 7/1976 | Grosch | 241/28 |

*Primary Examiner*—Howard N. Goldberg

*Assistant Examiner*—Robert P. Olszewski

*Attorney, Agent, or Firm*—Joseph P. House, Jr.

[57] ABSTRACT

Method and apparatus for loading a fresh bale of stacked wood pulp sheets into a continuously rotating bale milling cradle of a fluff generator, usually on top of a partially exhausted bale. A bale loader cradle is mounted above the bale milling cradle and is provided with mechanism for selectively holding the bale loader cradle stationary while the bale milling cradle continues to rotate and while a fresh bale is loaded into the bale loader cradle. When it is desired to transfer the fresh bale into the bale milling cradle, the two cradles are driven in synchronism with the cradles aligned. The floor of the bale loader cradle is then retracted and gravity transfers the fresh bale from the loader cradle into the bale milling cradle. After transfer has been completed, the bale loader cradle is stopped in alignment with a bale delivery conveyor to ready it to accept another fresh bale.

15 Claims, 7 Drawing Figures

BALE LOADER FOR FLUFF GENERATOR

BACKGROUND OF THE INVENTION

U.S. Pat. No. 3,967,785 issued July 6, 1976 discloses a method and apparatus for producing defibrated cellulose fluff from bales of compacted wood pulp sheets. The apparatus is referred to commercially as a fluff generator. In the apparatus therein disclosed, a bale milling cradle disposed within a rotating tub must be stopped when the bale therewithin has been completely processed and disintegrated, thus to permit a fresh bale to be loaded into the cradle. The need to stop the cradle while a fresh bale is loaded thereinto wastes production time and limits the output of the apparatus.

SUMMARY OF THE INVENTION

In accordance with the present invention, method and apparatus is provided to load fresh bales into the bale milling cradle while it continuously rotates and without requiring stoppage thereof. Accordingly, disintegration of the expiring bale continues during the process of loading a fresh bale into the cradle. This completely eliminates down time and fully utilizes the capacity of the apparatus.

In accordance with the present invention, a bale loader cradle is positioned adjacent and preferably directly above the bale milling cradle. The bale loader cradle is held stationary while the bale milling cradle continues to rotate and disintegration of the expiring bale continues. While the bale loader cradle is stationary, a fresh bale is loaded thereinto. When it is desired to transfer the fresh bale into the bale milling cradle, the bale loader cradle is freed for rotation and is driven at a speed synchronous with the speed of the bale milling cradle and with the two cradles aligned so that fresh and expiring bales having a rectangular outline will register one with the other. Thereupon the fresh bale is transferred from the bale loader cradle into the bale milling cradle, desirably by retracting the floor of the bale loader cradle so that the bale descends by gravity into the bale milling cradle, usually resting on top of the expiring bale. After transfer has been completed, rotation of the bale loader cradle is stopped and it is aligned with an input conveyor so that another fresh bale can be loaded thereinto.

In preferred embodiments of the invention, the bale loader cradle is selectively driven from the bale milling cradle and the two cradles are interlocked together during transfer.

The invention includes novel mechanism to selectively connect and disconnect the two cradles and also to hold the bale loader cradle stationary.

Other objects, features and advantages of the invention will appear from the disclosure hereof.

DESCRIPTION OF THE PREFERRED EMBODIMENT

Figure 1:
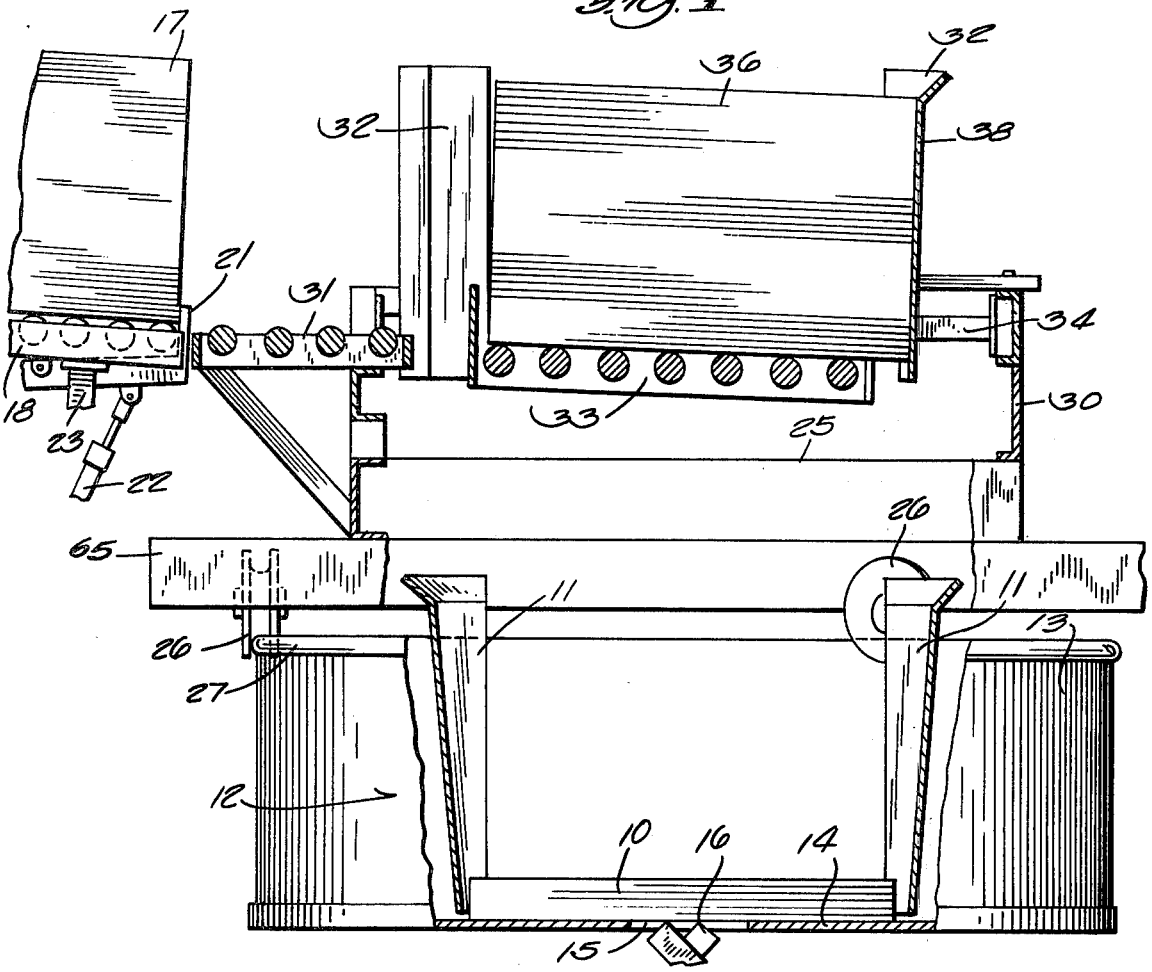
FIG. 1 is a view partly in side elevation and partly in cross section showing the assembly of apparatus embodying the invention.

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

U.S. Pat. No. 3,967,785 granted July 6, 1976 shows the basic structure of the fluff generator. The entire disclosure of said patent is incorporated herein by reference and many of the details illustrated in said patent will not be repeated here. As previously stated, the improvement to which this invention relates involves replacement of the bale carrier or sling 25 of the prior patent with bale loading apparatus which will function while the fluff generator continues to operate and the bale milling cradle rotates continuously.

Bales of stacked pulp sheets which are usually square or rectangular in outline are processed on the disclosed apparatus. Partially disintegrated or expiring bale 10 is embraced by the corner posts 11 of the bale milling cradle 12 which is mounted in a cylindrical tub 13 which rotates on a vertical axis. The bottom wall 14 of the tub 13 is provided with a cutting or milling port 15 which exposes the lowermost pulp sheet in bale 10 to the action of a rotating cutting mill 16. Tub 13 is rotated and fluff generation takes place as described in U.S. Pat. No. 3,967,785.

Fresh bales 17 (FIG. 1) arrive on a roller type input conveyor 18 and collect against a retractable stop 21 which is actuated by an air cylinder 22 mounted on bracket 23 depending from the frame of conveyor 18 in the same manner as is illustrated in FIG. 1 of U.S. Pat. No. 3,967,785.

Surmounting the tub 13 and bale milling cradle 12 is a bale loader cradle 24. Bale loader cradle 24 has a base frame 25 with grooved wheels 26 which ride on the rim 27 of the tub 13. Rim 27 provides both a support for the frame 25 and a circular track on which the wheels 26 will run during relative rotation between the two cradles 12, 24.

Mounted on the frame 25 is an intermediate frame 30 which supports the bale loader cradle 24 and also supports a stub roller conveyor 31 over which the fresh bales 17 are conveyed from the input conveyor 18 into the bale loader cradle 24.

Bale loader cradle 24 comprises four upright corner posts 32 in a square or rectangular pattern corresponding to the posts 11 on the bale milling cradle 12. When the bale milling cradle 12 is vertically registered with bale loader cradle 24, corner posts 32 will align vertically with the corner posts 11 on the bale cutter cradle 12. See particularly FIG. 4 which shows the two cradles with their corner posts 11, 32 in vertical alignment. The two corner posts 32 remote from input conveyor 31 have stop flanges 38 against which fresh bale 36 stops on arrival in cradle 24. The corner posts 32 adjacent input conveyor 31 do not have such stop flanges.

Figure 2:
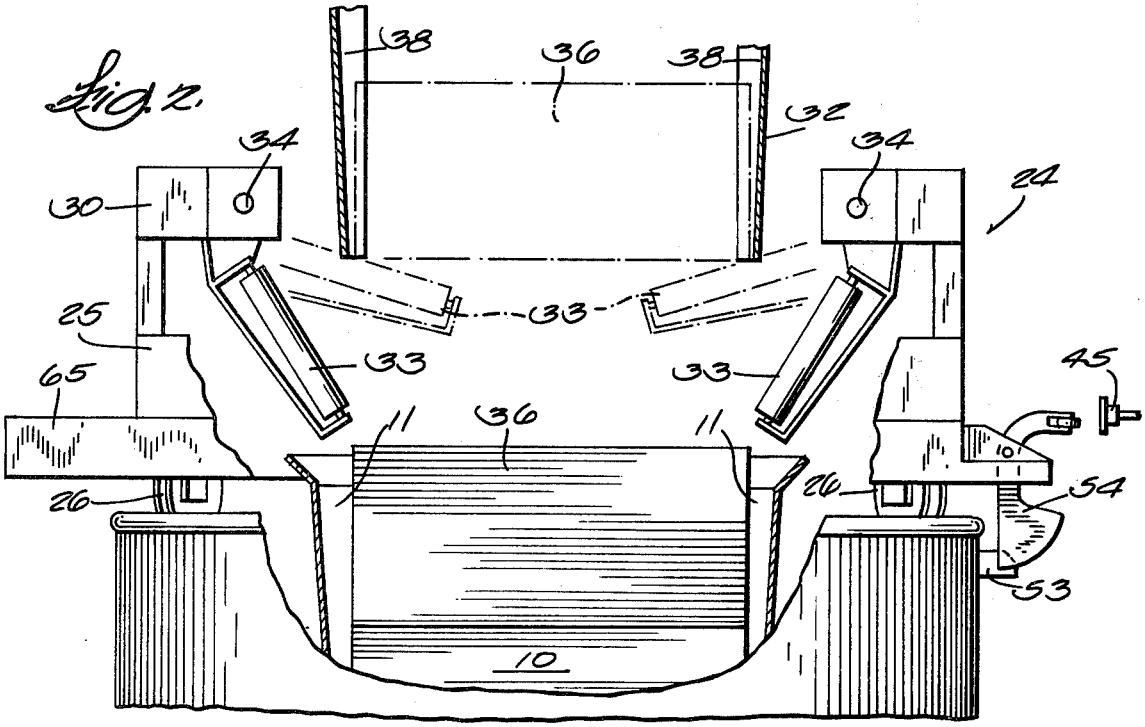
FIG. 2 is a fragmentary side elevation taken from a vantage point at a right angle to FIG. 1 and showing the bale loader cradle locked to the bale milling cradle. This view also illustrates retraction of the floor of the bale loader cradle to transfer a fresh bale by gravity from the bale loader cradle into the bale milling cradle.
Figure 3:
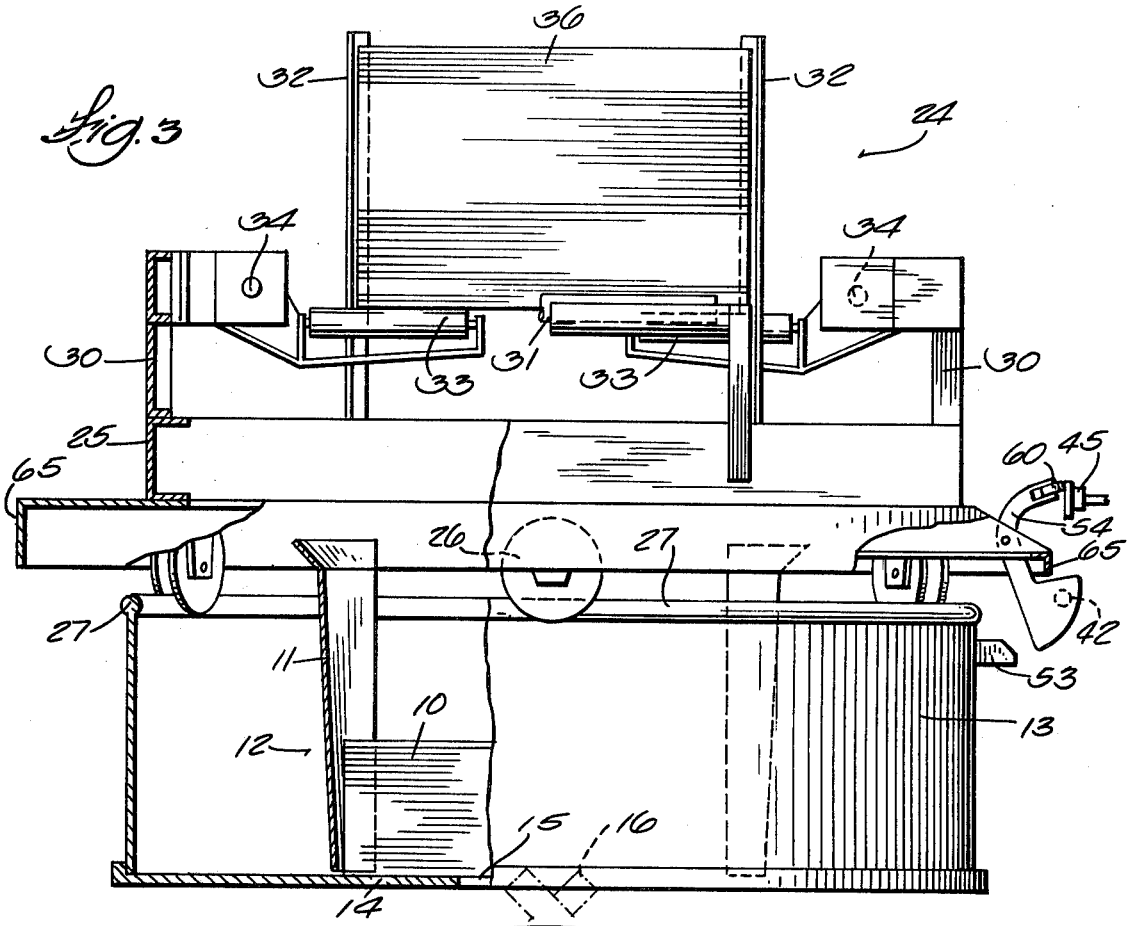
FIG. 3 is a view similar to FIG. 2, but showing the floor of the bale loader cradle supporting a fresh bale and showing the interlock between the bale loader cradle and the bale milling cradle in released position, whereby the bale milling cradle may continue to rotate while the bale loader cradle remains stationary.
Figure 4:
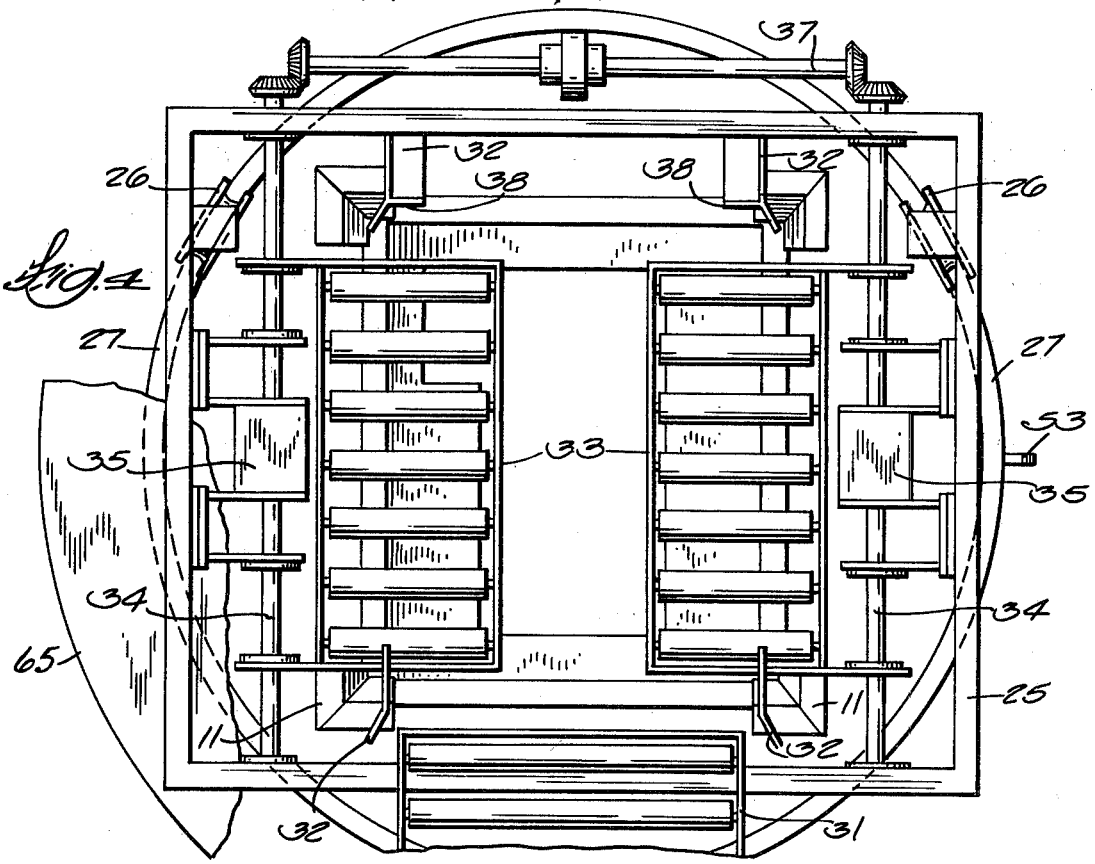
FIG. 4 is a plan view of the apparatus shown in FIG. 3.

The bale loader cradle 24 is provided with a retractable floor comprising paired roller conveyor sections 33 respectively connected to shafts 34 mounted in the frame 30. Each shaft 34 is provided with a fluid motor 35 (FIG. 4). Actuation of the motors 35 will rotate the shafts 34 to swing the roller conveyor floor sections 33 through various positions as illustrated in FIGS. 2 and 3. In FIG. 3, the floor sections 33 are in their uppermost positions in which they act to support a fresh bale 36 which has been delivered from input conveyor 18 into the bale loader cradle. In the course of transferring the bale 36 to the bale milling cradle 12 the conveyor sections 33 are tilted through their inclined positions shown in broken and full lines in FIG. 2 so that gravity will cause the bale 36 to descend into the cradle 12, usually on top of an expiring bale 10. In order to insure that both of the conveyor sections 33 will tilt at the same rate, shafts 34 are interconnected by a cross shaft 37 as shown in FIG. 4.

Means are provided to selectively lock the bale loader cradle 24 in alignment with the bale input conveyor 18 as shown in FIG. 1 and at the same time disconnect the bale loader conveyor 24 from the bale milling cradle 12, thus to permit continuous rotation of the bale milling cradle 12. Means is also provided to interlock the two cradles 12, 24 with their corner posts 11, 32 in vertical alignment, whereupon the two cradles rotate together on the same vertical axis in synchronism and the fresh bale 36 may be transferred by gravity from bale loader cradle 24 to the bale milling cradle 12. This means is illustrated in detail in FIGS. 5, 6 and 7 and is also shown in FIGS. 2 and 3.

Figures 5, 6, 7:
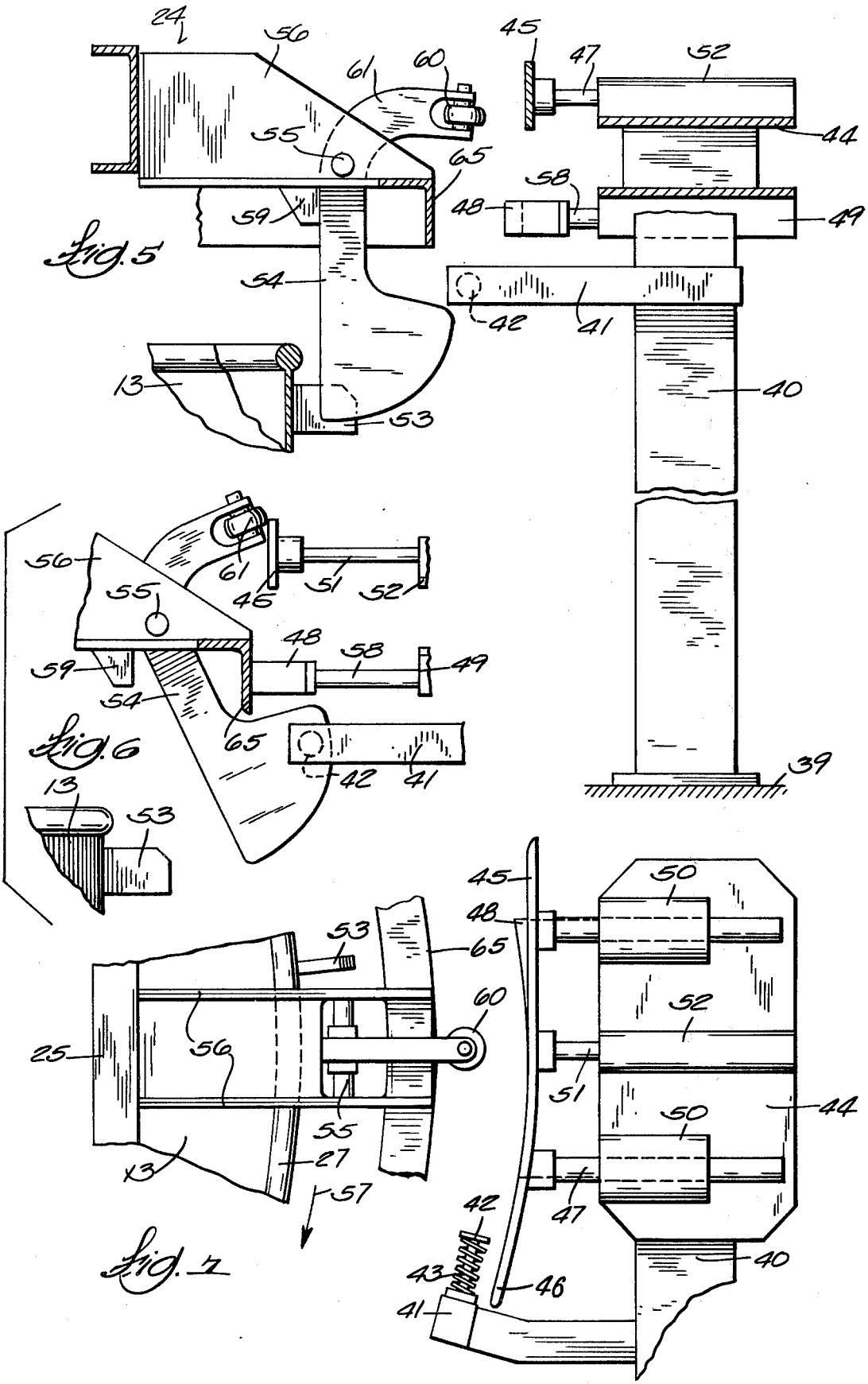
FIG. 5 is an enlarged fragmentary detail view illustrating parts of the interlock mechanism between the bale milling cradle, the bale loader cradle and a floor stand. In this view the two cradles are interlocked for synchronous rotation.
FIG. 6 is a fragmentary view similar to FIG. 5 but in which the interlock between the cradles is released to permit the bale milling cradle to rotate, while the bale loader cradle is interlocked to the floor stand.
FIG. 7 is a fragmentary plan view of the apparatus shown in FIG. 5.

The interlocking means aforesaid comprises a floor stand 40 mounted on floor 39 (FIG. 5). Stand 40 carries at its top a fixed stop 41 (FIG. 7) which is provided with a snubber 42 having a shock absorbing spring 43. Floor stand 40 also carries a platform 44 on which a cam shoe 45 and a brake shoe 48 are mounted. Shoe 45 is elongated in the direction 57 of rotation of tub 13 and is desirably curved toward tub 13 at its end 46 shown in FIG. 7. Cam shoe 45 is mounted for movement toward and away from tub 13 on guide rods 47 which are slidable in sleeve bearings 50 mounted on platform 44. Cam shoe 45 is further provided with an actuator comprising an air cylinder 52 having piston rod 51 coupled to the cam shoe. Brake shoe 48 is actuated by air cylinder 49 connected to the shoe 48 by piston rod 58.

Mounted on the side of bin 13 is a laterally projecting drive lug 53. Mounted on frame 25 for the bale loader cradle 24 is a swing latch arm 54. Latch arm 54 is swingably connected on pintle 55 to paired brackets 56 mounted on frame 25 and is swingable laterally with respect to the arcuate path of movement of drive lug 53. Two positions of swing arm 54 are respectively shown in FIGS. 5 and 6.

In FIG. 5, the latch arm 54 is free to assume by gravity a vertically upright position in which latch arm 54 rests against stop 59 and is in the path of drive lug 53. Accordingly, rotation of the bin 13 in the clockwise direction of arrow 57 in FIG. 7 will cause drive lug 53 to engage the latch arm 54 and pick up and drive the bale loading cradle 24 with the bin 13, at the same speed and in synchronism therewith. This condition is also illustrated in FIG. 2 and obtains when it is desired to transfer fresh bale 36 in bale loading cradle 24 to the bale milling cradle 12.

When it is desired to stop rotation of bale loading cradle 24 in alignment with the bale input conveyor 18, air cylinder 52 is actuated to advance cam shoe 45 to its position shown in FIG. 6. Accordingly, as the rotating bale loader cradle 24 continues to rotate, it will reach a point where cam follower roller 60 on arm 61 of the latch 54 is engaged by cam shoe 45. Continued rotation of cradle 24 will cause the roller 60 to follow the curve of cam shoe 45 and swing latch arm 54 about its pintle 55 to its position shown in FIG. 6 and withdraw the latch arm 54 from engagement with the drive lug 53 on bin 13. Disengagement of the latch arm 54 from drive lug 53 frees the bin 13 to continue to rotate independently of the bale loader cradle 24.

Swinging of the latch arm 54 to its FIG. 6 position also disposes latch arm 54 in alignment with the snubber 42 on stop 41 mounted on floor stand 40. Accordingly, immediately after the bin 13 is freed from interconnection to the bale loader cradle, latch arm 54 engages the snubber 42 and the bale loader cradle will be stopped in alignment with the bale input conveyor 18, as shown in FIG. 1. The shock of impact of latch arm 54 against stop 41 is absorbed by spring 43. Air cylinder 49 is also actuated to engage brake shoe 48 with a complementary brake surface 65 on the bale loader cradle frame 25, thus to hold the cradle 24 in stopped position.

It is clear from the foregoing that the same latch 54 by which the bale loading cradle 24 is driven from the continuously rotating bin 13 is also utilized to stop the cradle 24 from rotating. Control over stopping and starting the cradle 24 is effectuated by the actuation and deactuation of the air cylinders 52, 49.

The sequence of events appears from the foregoing description but can be summarized as follows:

With latch arm 54 in its position shown in FIGS. 3 and 6, bale loading cradle 24 is stationary and is in alignment with the bale loading conveyor 18 so that a fresh bale may be moved from the conveyor 18 onto the cradle 24 by actuation of the gate 21 and gravity conveyance of the bale over the stub conveyor 31.

When the expiring bale 10 in bale milling cradle 12 has been reduced in height a sufficient amount to provide space to receive a fresh bale 36, the operator will actuate air cylinders 52 and 49 to withdraw cam shoe 45 and brake shoe 48 to their positions shown in FIGS. 5 and 7. Thereupon, gravity will swing the latch arm 54 to its position shown in FIGS. 2 and 5. After the bin 13 has completed less than one revolution, drive lug 53 will engage the depending latch arm 54 and will pick up the bale loading cradle 24 and drive the bale loading cradle and its fresh bale 36 in synchronism with the bale milling cradle 12. The operator may now actuate motors 35 (FIG. 4) to withdraw the swinging floor sections 33 from beneath the fresh bale 36 which will then drop by gravity into the cradle 12 and on top of the expiring bale 10, as shown in FIG. 2. In due course, the operator will reverse motors 35 to restore the swinging floor sections 33 to their uppermost positions.

To reload a fresh bale 17 from input conveyor 18 into the bale loading cradle 24, the operator will actuate air cylinder 52 to project shoe 45 to its position shown in FIGS. 3 and 6, whereupon in less than one revolution of the cradles 12, 24, the elevated latch arm 54 will engage the snubber stop 42 and stop rotation of the bale loader cradle 24 in alignment with the bale feeding conveyor 18. Air cylinder 49 is also actuated to engage brake shoe 48 with brake surface 65 or cradle 24.

At all times the bin 13 and its contained bale milling cradle 12 continues to rotate and the bale therewithin is acted upon by the cutting mill 16. The technique herein disclosed eliminates down time in transferring a fresh bale to the fluff generator.

I claim:

1. A method of loading a fresh bale of stacked sheets of wood pulp into a continuously rotating bale milling cradle and comprising the steps of positioning a bale loading cradle adjacent the bale milling cradle, holding the bale loading cradle stationary while the bale milling cradle continues to rotate, loading the fresh bale into the stationary bale loading cradle, freeing the bale loading cradle for rotation, rotating the bale loading cradle in synchronism with the bale milling cradle and in alignment therewith, transferring the bale from the bale loading cradle into the bale milling cradle while both cradles rotate in synchronism, and after transfer has been completed stopping rotation of the bale loading cradle to ready it to accept another fresh bale.

2. The method of claim 1 in which the bale loading cradle is above the bale milling cradle and both rotate on a substantially vertical axis, the step of transferring the bale from the bale loading cradle to the bale milling cradle comprising the step of withdrawing support for the bale so that it will descend by gravity into the bale milling cradle.

3. The method of claim 1 in which the step of rotating the bale loading cradle comprises the step of interlocking it with the bale milling cradle so that the bale milling cradle drives the bale loader cradle in synchronism therewith.

4. Apparatus for loading a fresh bale of stacked wood pulp sheets into a continuously rotating bale milling cradle and comprising a bale loader cradle adjacent the bale milling cradle, means for holding the bale loading cradle stationary while the bale milling cradle continues to rotate, means for loading the fresh bale into the bale loader cradle, means for releasing the bale loading cradle to permit it to rotate, means for rotating the bale loader cradle in synchronism with the bale milling cradle and in alignment therewith, means for transferring the bale from the bale loading cradle into the bale milling cradle while both cradles rotate in synchronism and means to stop rotation of the bale loader cradle to ready it to accept another fresh bale after said transfer has been completed.

5. The apparatus of claim 4 in which the bale loader cradle is vertically above the bale milling cradle and both are mounted for rotation about a substantially vertical axis, said bale loader cradle having a retractable floor and means for retracting the floor from beneath a bale so that the bale will descend by gravity into the bale milling cradle in the course of transferring the bale from the bale loader cradle into the bale milling cradle.

6. The apparatus of claim 4 in which the means to rotate the bale loader cradle in synchronism with the bale milling cradle comprises means for interlocking the two cradles together so that the bale milling cradle drives the bale loader cradle in synchronism therewith.

7. The apparatus of claim 4 in which the bale is rectangular in cross section and in which the bale milling cradle comprises corner posts which engage the corners of the bale and guide its descent by gravity against a cutting mill, said bale loader cradle having corner posts which align with the corner posts of the bale milling cradle when the two cradles are driven together.

8. The apparatus of claim 4 in which the bale milling cradle comprises a tub having a circular rim, the bale loader cradle having wheels engaged with the tub rim whereby to support the bale loader cradle from the bale milling cradle.

9. The apparatus of claim 8 in which the means to hold the bale loading cradle stationary while the bale milling cradle continues to rotate comprises a floor stand having a latch selectively engageable with the bale loader cradle to hold it against rotation while its wheels continue to support the bale loader cradle from the rotating tub of the bale milling cradle.

10. The apparatus of claim 4 in which the means to rotate the bale loader cradle in synchronism with the bale milling cradle comprises a latch selectively interconnecting the two cradles.

11. The apparatus of claim 10 in which said latch also comprises means to hold the bale loader cradle stationary when it disconnects the two cradles.

12. The apparatus of claim 10 in which said latch comprises the bale milling cradle having a drive lug, said bale loader cradle having a latch arm which in one position is engaged by said drive lug whereby the bale milling cradle will drive the bale loader cradle, said latch arm having another position out of range of said drive lug and a floor stand having a stop in the path of the latch arm in its said other position to intercept the latch arm and to stop the bale loader cradle in its stationary position.

13. The apparatus of claim 12 in which said latch arm has a cam follower and cam means selectively engageable with the cam follower to move the latch arm from one position to the other.

14. The apparatus of claim 13 in which said cam means comprises a cam shoe and means to move the cam shoe toward and away from the path of the latch arm cam follower.

15. The apparatus of claim 12 in which the stop is provided with a resilient snubber.

* * * * *